US008640601B2

(12) United States Patent
Schmid

(10) Patent No.: US 8,640,601 B2
(45) Date of Patent: Feb. 4, 2014

(54) OUTPUT SYSTEM FOR A PLURALITY OF MASSES

(75) Inventor: Christoph Schmid, Maisach OT Gerlinden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/423,529

(22) Filed: Mar. 19, 2012

(65) Prior Publication Data

US 2012/0285151 A1 Nov. 15, 2012

Related U.S. Application Data

(63) Continuation of application No. PCT/EP2010/063039, filed on Sep. 6, 2010.

(30) Foreign Application Priority Data

Sep. 18, 2009 (DE) ..... 10 2009 029 607

(51) Int. Cl.
*F15B 13/06* (2006.01)

(52) U.S. Cl.
USPC ..... 91/508; 91/523

(58) Field of Classification Search
USPC ..... 91/508, 530, 535, 521, 523; 92/146; 417/46, 349, 390, 393
See application file for complete search history.

(56) References Cited

U.S. PATENT DOCUMENTS

| | | | | |
|---|---|---|---|---|
| 3,672,389 | A | 6/1972 | McConnell et al. | |
| 4,030,860 | A | 6/1977 | Standlick | |
| 4,093,404 | A | 6/1978 | Soehngen et al. | |
| 4,304,529 | A | 12/1981 | Gerich | |
| 8,037,678 | B2 * | 10/2011 | McBride et al. | 91/508 |

FOREIGN PATENT DOCUMENTS

| | | |
|---|---|---|
| DE | 19511758 | 10/1996 |
| DE | 29706074 | 7/1997 |
| EP | 0904927 | 3/1999 |

OTHER PUBLICATIONS

International Search Report in connection with International Patent Application No. PCT/EP2010/063039 mailed Jan. 18, 2011.

* cited by examiner

*Primary Examiner* — Michael Leslie
(74) *Attorney, Agent, or Firm* — James E. Piotrowski; Steven C. Bauman

(57) ABSTRACT

An output system (100) for the extraction and/or output of plural masses (220), comprising a cylinder unit (300) made up of at least two double-acting cylinders (301, 304) each having a piston (303), displaceable by means of a piston rod (302, 305), for extraction and/or output of one of the masses (220) in each case, the piston rods (302, 305) being arranged parallel to one another and being connected to one another via at least one connecting element (307) in such a way that the connected piston rods (302, 305) are displaceable as a unit; and comprising a control unit (200) made up of at least two valves (201, 204) for controlling the entry and return of the masses (220) to the cylinders (301, 304).

10 Claims, 5 Drawing Sheets

OUTPUT SYSTEM FOR A PLURALITY OF MASSES

Figure 1:
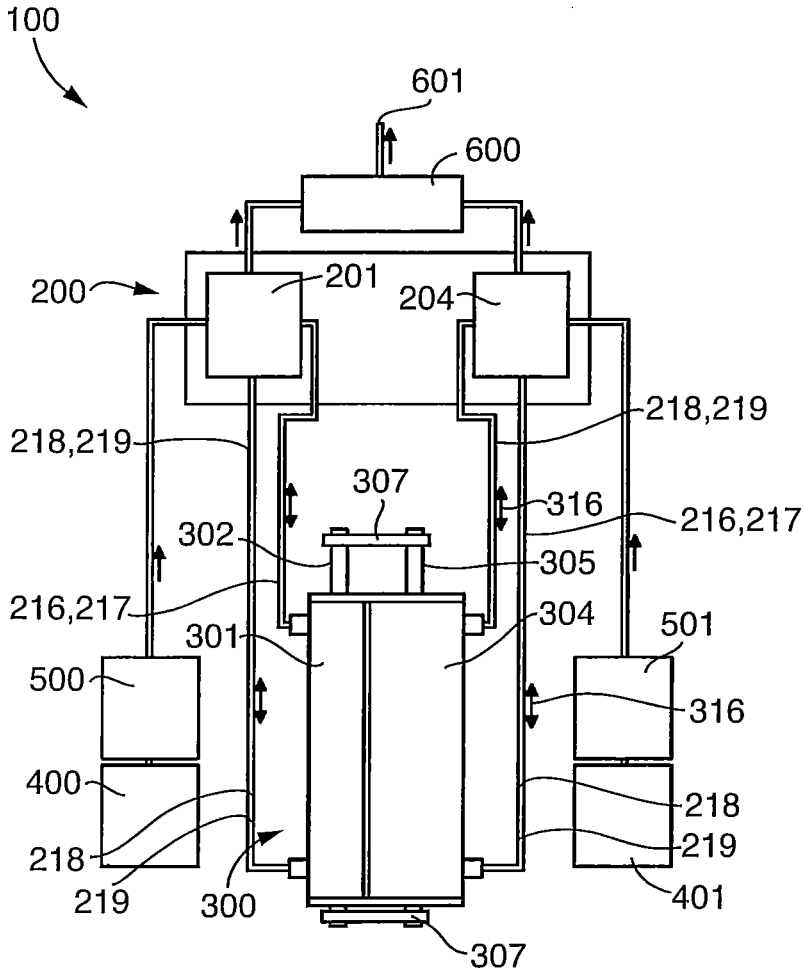

The invention relates to an output system for extracting and/or outputting plural masses such as, for example, multi-component adhesives. Such output systems are used in particular in industry in order to output, for example, two-component adhesives, the two different components being extracted from corresponding containers.

U.S. Pat. No. 4,304,529 provides an apparatus for the output of two miscible fluids that can be outputted at a predetermined ratio. Provided for this is a first valve mechanism that is used to convey the first component, as well as a second valve mechanism for conveying the second component. A pump unit and a dispensing unit is respectively connected to the two valve mechanisms, the dispensing units and the valve mechanisms being controlled by means of a switching mechanism. A constant ratio of the two components upon output can be achieved by way of a construction of this kind, so that a homogeneous adhesive can be outputted after mixing of the emerging components. The two valve mechanisms are connected via a common piston rod that drives a respective piston by means of a respective volumetric flow of the respective component. The solution presented is problematic in particular in terms of the space requirement of an apparatus of this kind.

An object of the invention is therefore to furnish an improved apparatus that, because of its design, has a lesser space requirement.

This object is achieved with the features of claim 1.

Refinements of the invention are indicated with the dependent claims.

The basic idea of the invention is the provision of an output system for the extraction and/or output of plural masses, comprising a cylinder unit made up of at least two double-acting cylinders each having a piston, displaceable by means of a piston rod, for extraction and/or output of one of the masses in each case, the piston rods being arranged parallel to one another and being connected to one another via at least one connecting element in such a way that the connected piston rods are displaceable as a unit; and a control unit made up of at least two valves for controlling the entry and return of the masses to the cylinders.

The space requirement can be minimized as a result of the arrangement of the cylinders in such a way that the piston rods are arranged parallel to one another. Thanks to the use of a connecting element for connecting the piston rods arranged parallel to one another, it is possible in particular to achieve a synchronous displacement of the piston rods so that the connected piston rods are displaceable as a unit.

A further advantage is the use of synchronized-speed cylinders as double-acting cylinders, the piston rods being connected to one another on both sides of the cylinders by means of the connecting elements. Synchronized-speed cylinders of this kind can retain a piston rod on both sides of the piston surface. The use of synchronized-speed cylinders has the advantage that upon a displacement of the piston in the one stroke direction, mass is outputted from the one chamber, while at the same time mass can be received by the second chamber. Upon a reversal of the stroke direction, a correspondingly opposite movement of mass occurs. Mass can thus be received resp. delivered with each movement of the piston. Particularly preferably, the piston rods are connected to one another on both sides of the cylinders by means of the connecting elements. It is thus possible, in particular, to achieve a good operational connection of the two piston rods so that, in particular, synchronous output of the masses at a predetermined ratio can be ensured.

A further advantage is the use of slider valves to control the entry and return of the masses. This refers to a valve in which the connectors are connected to or separated from one another by a sliding element. The motion can then occur in particular axially, rotationally, or in a combination thereof. Use of an axial motion is preferable, as is a rectangular shape of the sliding element. Slider valves of this kind are also known as "flat slider valves." Piston valves or rotary slider valves, however, which are sufficiently known in the existing art, can of course also be used. The slider valves are by preference pneumatically controlled. The flow direction at the cylinder connectors can be adjusted by way of the slider valves; this is advantageous in particular when identically functioning cylinders are used.

A further advantage in this context is the use of slider valves that comprise displaceable switching elements which are displaceable by means of a switching rod, the switching rods of the slider valves being arranged parallel to one another. The parallel arrangement of the switching rod of the respective slider valves is suitable in particular in the context of a parallel arrangement of the piston rods of the double-acting cylinders, for example in the interest of positional independence of the apparatus according to the present invention. For example, with such an arrangement the same forces, such as e.g. gravitational forces, often act on the piston rods resp. the switching rods; especially when the apparatus is in an oblique position, this can be advantageous in terms of a flat foundation, so that a constant and synchronous output of mass from all cylinders can be used.

A further advantage in this context is the connection of the switching rods of the slider valves via at least one connecting element, so that the connected switching rods are displaceable as a unit. It is thereby possible to achieve, in particular, a synchronous response of the cylinders, which can lead to synchronous output of mass. It is moreover possible to ensure that with preferably pneumatically controlled switching rods, even in the event of failure of a rod's pneumatic control system, the rod is co-moved by means of the connecting element by a further switching rod having an intact pneumatic control system, so that an operating down time is avoided with the apparatus.

A further advantage is the use of a conveying pump to convey at least one mass, and the displacement of at least one piston of at least one cylinder by means of the mass. An approach of this kind allows a movement mechanism or propulsion mechanism of the cylinder to be omitted. The motion of the cylinder occurs in accordance with the conveyance via the conveying pump.

Figure 2:
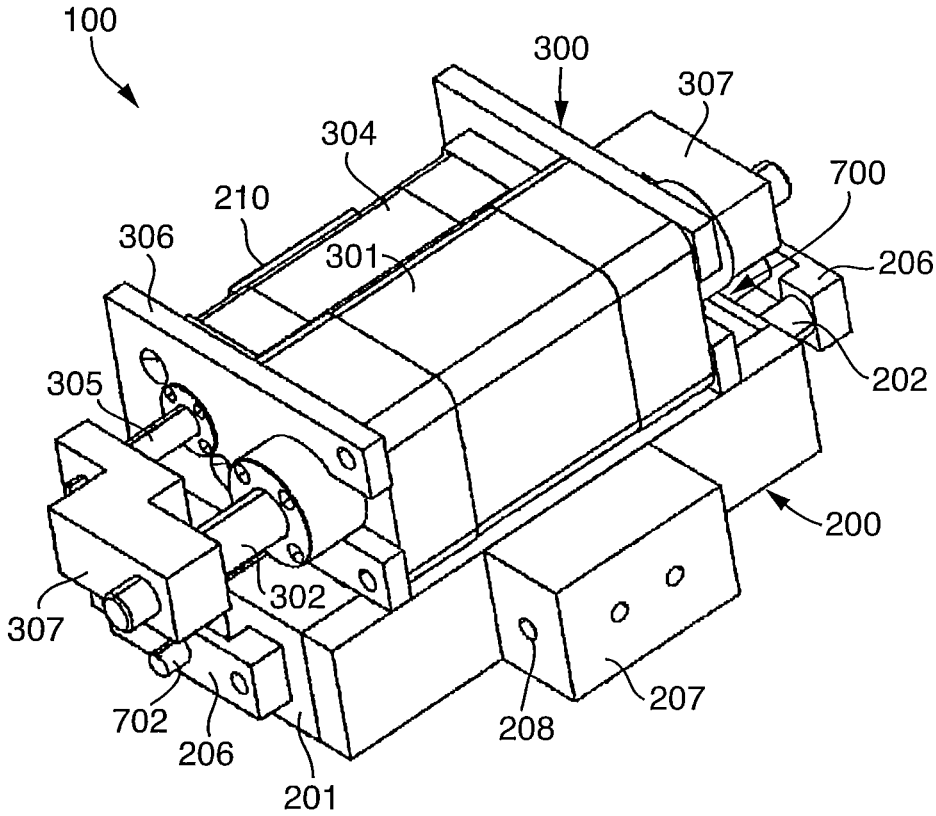
Figure 3:
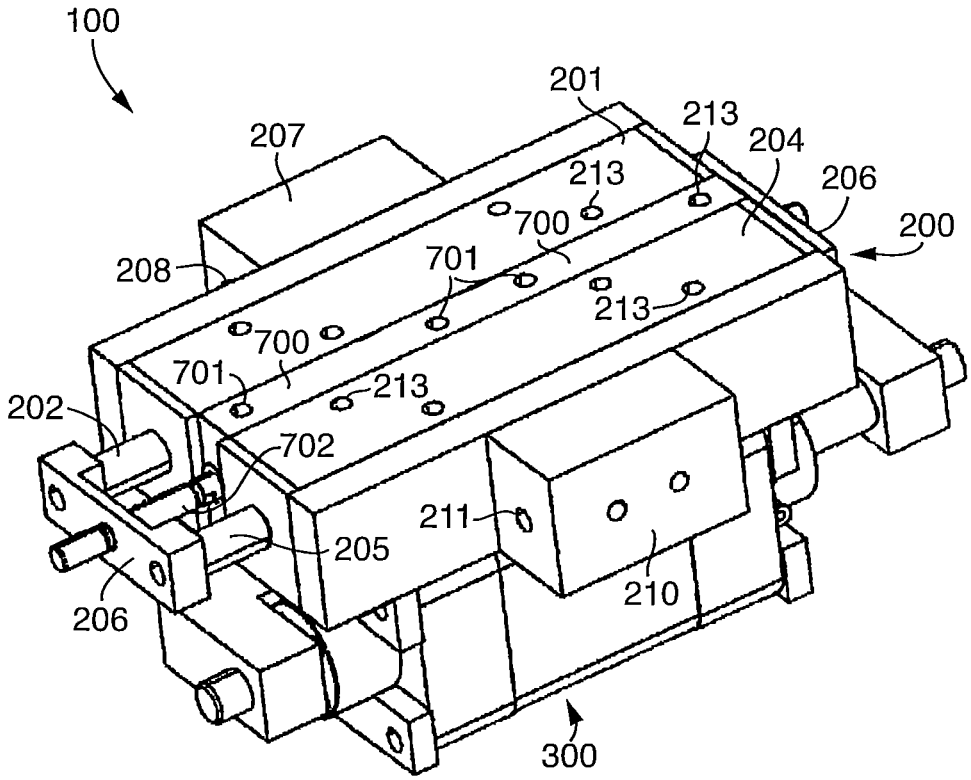
Figure 4:
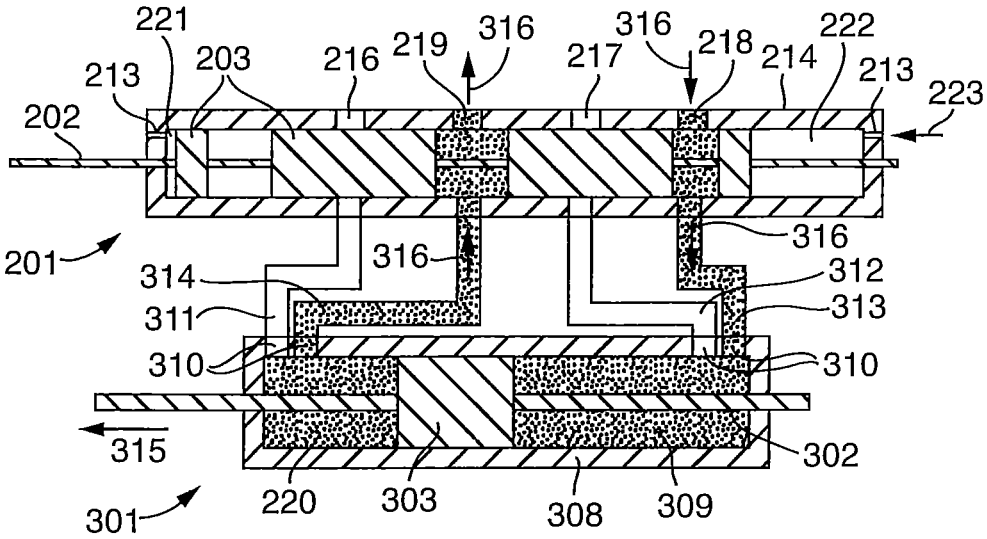
Figure 5:
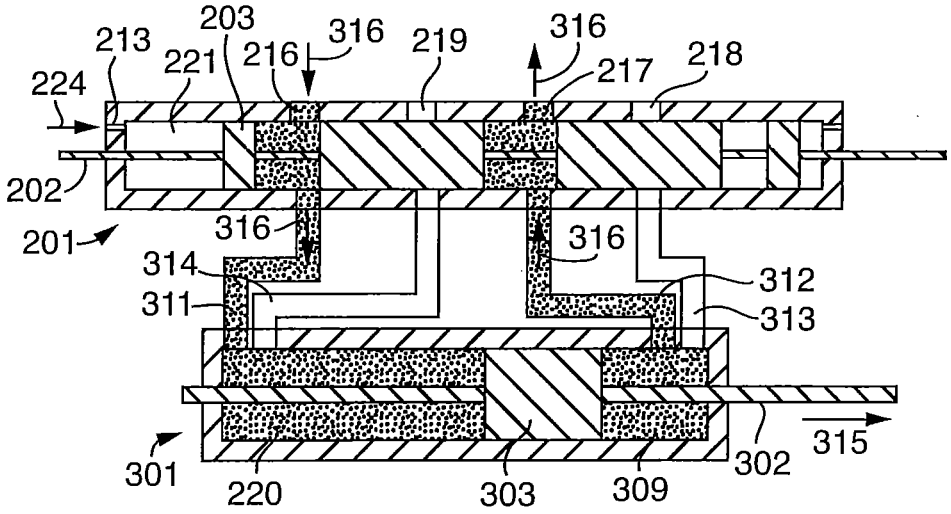
Figure 6:
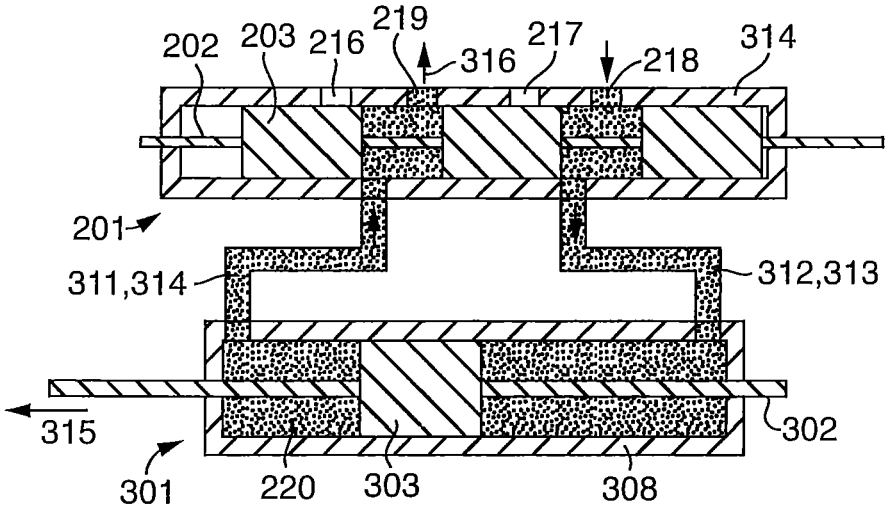
Figure 7:
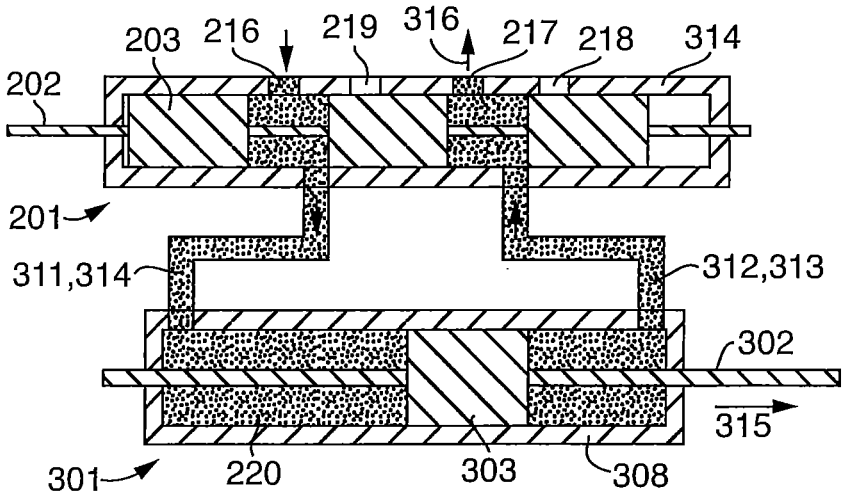

The invention is explained in further detail below, by way of example, with reference to the drawings, in which FIG. 1 is a functional diagram of an output system according to the present invention;

FIG. 2 is a perspective view of the output system according to the present invention from FIG. 1, FIG. 3 is a perspective view of the underside of the output system of FIG. 2, FIG. 4 is a sectioned side view of a functional diagram of a valve-cylinder arrangement of the output system of FIG. 2, FIG. 5 shows the functional diagram of FIG. 4 with the valve-cylinder arrangement in a state different from the state shown in FIG. 4, FIG. 6 is a sectioned side view of an alternative functional diagram of a valve-cylinder arrangement of the output system of FIG. 2, FIG. 7 shows the functional diagram of FIG. 6 with the valve-cylinder arrangement in a state different from the state shown in FIG. 6.

An output system 100 depicted in the Figures is suitable in particular for conveying and outputting a product made up of plural masses. In the present case a two-component adhesive is used as the product to be conveyed and outputted. Also conceivable, of course, is conveyance of other multi-component products, in particular in industry and the trades, for example in the chemical or pharmaceutical industry. Even the use of output system 100 in the food sector is conceivable.

FIG. 1 is a functional diagram of an output system 100 according to the present invention having further peripheral or additional apparatuses that need not necessarily be part of output system 100. Output system 100 comprises a cylinder unit 300 made up of a first cylinder 301 and a second cylinder 304. Cylinders 301, 304 serve to convey, at a previously defined ratio, the masses that are to be outputted. Double-acting cylinders 301, 304, which each comprise a piston 303 displaceable by means of a piston rod 302, 305 for extraction and/or output of one mass in each case, are used in output system 100 that is shown. In the exemplifying embodiment shown, piston rods 302, 305 are arranged parallel to one another and are connected to one another, at the ends protruding out of the cylinder housings, via two piston rod yokes 307 as connecting elements, in such a way that the connected piston rods 302, 305 are displaceable as a unit. It is possible in this way to guarantee that the masses are always outputted at the same ratio, since by way of the connection of the piston rods 302, 305 is it possible to ensure that the pistons of cylinders 301, 304 always move together and at the same speed. The ratio between the masses that are to be outputted is determined by the cubic capacity of cylinders 301, 304. The larger the cubic capacity of a cylinder 301, 304, the more mass can be outputted. In the present exemplifying embodiment, the one cylinder 301 has, for the same length, a smaller diameter than second cylinder 304. Less mass is therefore conveyed by means of first cylinder 301 than by means of second cylinder 304. A change in the ratio of the masses, for example in the context of a desired change in the composition of the product to be outputted, can be ensured e.g. by exchanging one of the cylinders 301, 304. For this, in particular, the connection between piston rod yoke 307 and piston rods 302, 305 can be configured separably or releasably.

The arrangement of cylinders 301, 304 in such a way that piston rods 302, 305 are arranged parallel to one another allows the space requirement to be minimized. The use of piston rod yokes 307 to connect piston rods 302, 305 that are arranged parallel to one another allows, in particular, a synchronous displacement of piston rods 302, 305 to be achieved, so that the connected piston rods 302, 305 are displaceable as a unit.

The output system can of course also be utilized for conveyance and output of a product that is made up of three or more masses. Further cylinders (not shown) are used for this, the piston rods of these cylinders by preference being arranged parallel to piston rods 302, 305 of cylinders 301, 304 that are shown, and being connected thereto by means of piston rod yokes 307.

Output system 100 furthermore comprises a control unit 200, made up of two slider valves 201, 204, for controlling the entry and return of the masses to cylinders 301, 304. Slider valves 201, 204 are respectively connected via two valve inlet lines 216, 218 resp. valve return lines 217, 219 to cylinders 301, 304 in order to enable an inflow resp. backflow of mass. In addition, a conveying pump 500, 501 is respectively attached to slider valves 201, 204 by means of a feed conduit, in order to convey the two masses respectively from a first and a second reservoir 400, 401.

Cylinders 301, 304 of output system 100 that is shown do not possess their own drive system. The pistons of cylinders 301, 304 are instead displaced within cylinders 301, 304 by the masses themselves, by means of conveying pumps 500, 501, in which context control unit 200 controls the entry resp. return of the masses into and from cylinders 301, 304.

Also attached to slider valves 201, 204 are output conduits that enable an output of mass to a mixing apparatus 600, in which the conveyed masses are mixed with one another. The multi-component mixture resulting from the components can then be delivered resp. extracted by means of an output opening.

FIG. 2 is a perspective view of the upper side of an output system 100 according to the present invention. The output system is depicted without further peripheral and auxiliary apparatuses that serve for output of a multi-component product. In particular, conveying pumps for the masses, pneumatic units for control, and mixing apparatuses for the masses are not illustrated. Output system 100 according to the present invention that is depicted serves for output synchronization, at a defined ratio, of the masses to be outputted. For this, cylinder unit 300 is provided with the two cylinders 301, 304 connected by means of a mounting plate 306; piston rods 302, 305, arranged parallel to one another, are respectively connected at their two ends protruding out of the cylinder housings by means of two piston rod yokes 307, in such a way that they are displaceable as a unit. Cylinders 301, 304 are driven by the masses, by means of the conveying pumps (not shown).

In the embodiment shown, double-acting cylinders 301, 304 are used. More precisely, synchronized-speed cylinders 301, 304, which comprise piston rods 302, 305 on both sides of the pistons (concealed by the cylinder housing), are used. The pistons are displaced by conveyance of the masses and by filling of the one chamber of a cylinder 301, 304 on the one respective side of the piston. As a result of the connection of the two piston rods 302, 305 by means of piston rod yokes 307, a shifting of the piston of first cylinder 301 results in a shifting of the piston of second cylinder 304, and vice versa. If it should be impossible to convey a mass in sufficient quantity, the cylinder 301, 304 connected to the weaker conveying pump can nevertheless decelerate the respective other cylinder 301, 304 as a result of the connection of piston rods 302, 305. In all cases, a shared movement of piston rods 302, 305, and thus of the pistons can be ensured.

Control unit 200, made up of first slider valve 201 and second slider valve 204, is connected to cylinder unit 300. Slider valves 201, 204 serve to control the entry and return of the masses, in particular for cylinders 301, 304. First slider valve 201 a switching rod 202 protruding on both sides out of the valve housing. The switching rod, likewise protruding on both sides out of the valve housing, of second slider valve 204 is concealed by cylinder unit 300. The two switching rods 202 are arranged parallel to one another and are connected to one another via a valve yoke 206 in such a way that the connected switching rods 203, 205 are displaceable as a unit. In addition, output system 100 that is shown comprises a pneumatic cylinder 700, arranged between the two slider valves 201, 204 and having a piston rod 702 that protrudes on both sides out of the housing of pneumatic cylinder 700. Piston rod 702 is connected to valve yoke 206. By means of pneumatic cylinder 700, valve yoke 206 can be shifted by way of a displacement of piston rod 701, which results in a displacement of switching rods 202 of the two slider valves 201, 204.

Output system 100 furthermore comprises a first connector adapter 207 and a second connector adapter 2010. First connector adapter 207 comprises a feed opening 208 for entry of the mass by means of, preferably, a conveying pump, as well as a concealed return opening onto which can be connected, for example, a mixing apparatus (not depicted) for mixing the masses. The second connector adapter likewise comprises a respective feed opening and return opening, although these are concealed in the case of output system 100 that is shown.

FIG. 3 is a perspective view of the underside of output system 100 of FIG. 2. Valve unit 200, which is made up of slider valves 201, 204 arranged next to one another and is connected to cylinder unit 300, is evident. Pneumatic cylinder 700 is provided between slider valves 201, 204. For activation of pneumatic cylinder 700, the latter comprises multiple pneumatic connectors 701. Piston rod 702 of pneumatic cylinder 700 can thereby be shifted. Said rod is connected at the ends protruding out of the housing of pneumatic cylinder, via valve yokes 206, to switching rods 202, 205, arranged parallel to one another, of slider valves 201, 204. The two switching rods 202, 205 can thus be displaced by a displacement of piston rod 702, so that the entry resp. return for cylinder unit 300 can be controlled by means of control unit 200 via pneumatic cylinder 700. The connection of the two switching rods 202, 205 via valve yokes 206 makes it possible to guarantee a synchronous displacement of switching rods 202, 205 by means of piston rod 702, and thus a synchronous activation of the cylinders of the cylinder unit. Furthermore, slider valves 201, 203 can additionally or alternatively be equipped with further pneumatic connectors 213 in order to enable additional or alternative activation of slider valves 201, 203. For example, slider valves 201, 203 can be directly pneumatically controlled so that the pneumatic cylinder can be omitted. In addition, output system 100 comprises first and second connector 207, 210; a feed opening 208 for the mass fed in from the conveying pump (not depicted) is provided at first connector adapter 207, and a feed opening 211 at second connector adapter 210. The return openings of the two adapters 207, 210 are concealed.

FIG. 4 is a sectioned side view of a functional diagram of a valve-cylinder arrangement of output system 100 of FIG. 2. The sectioned view shows first slider valve 201 and first cylinder 301, but the second slider valve and second cylinder (not depicted) can also have the same mode of operation and the same features. In the present exemplifying embodiment, slider valve 201 is directly pneumatically controlled. Use of the above-described pneumatic cylinder to activate slider valve 201 is thus superfluous. Instead, pneumatic connectors 213, which communicate respectively with a first and a second actuation space 221, 222, are provided on a valve housing 214 of slider valve 201 at both end regions. Provided within slider valve 201 is a switching rod 202 having multiple switching elements 203 that can be displaced. Switching rod 202 protrudes on both sides of slider valve 201, through valve orifices 215, out of housing 214 of said valve, and is connected here by means of one or more valve yokes (not shown) to the or to the further slider valve(s). Switching elements 203 are fixedly connected to switching rod 202. Switching elements 203 facing toward actuation spaces 221, 222 serve to seal actuation spaces 221, 222, and serve as shunting pistons for displacing switching rod 202 when pressure is applied to actuation spaces 221, 222. In the present exemplifying embodiment, second actuation space 222 of slider valve 201 has had pressure applied to it by means of one the pneumatic connectors 213, so that switching rod 202 with switching elements 203 has been displaced in a first pressure action direction 223. This displacement capability of switching rod 202 makes possible the control function of slide valve 201 by means of switching elements 203. Depending on the position of switching rod 202, switching elements 203 can cover or uncover a first and second valve inlet line 216, 218 and a first and second valve return line 217, 219, and corresponding first and second inlet lines 311, 313 as well as first and second return lines 312, 314 on cylinder 301, in order to provide communication between cylinder 301 and, for example, the conveying pump and the output apparatus, for example a mixer having an output opening.

Cylinder 301 comprises four distributing valves 310 at which inlet lines 311, 313 and return lines 312, 314 are connected resp. provided. The housing of cylinder 301 encloses a tubular chamber 309 in which a piston 303 connected to piston rod 302 can be displaced, which divides tubular chamber 309 into two regions. Cylinder 301 is filled with mass 220 to be outputted. In other words, mass 220 fills up tubular chamber 309 on both sides of piston 303. Piston rod 302 protrudes out of a cylinder housing 308 on both sides thereof, and can be connected at the protruding ends, via one or more above-described connecting yokes, to further cylinders in order to ensure synchronization of the cylinders that are utilized.

With switching rod 202 in the position shown, switching elements 203 permit communication between second valve inlet line 218 and second inlet line 313 of cylinder 301, and between second return line 314 of cylinder and second valve return line 219. In this state, the conveying pump connected to valve inlet line 218 can pump mass 220 in a product flow direction 316 through slider valve 201 into the one side of tubular chamber 309 of the cylinder, and thereby displace piston 303 in a piston motion direction 315. In that context, piston 303 pushes mass 220, provided on the other side of tubular chamber 309, out of the opened return line 314 through slider valve 201 to valve return line 219 and, for example, to a connected mixing apparatus. Cylinder 301 thus does not possess its own drive system for displacing piston 303. Displacement instead occurs by way of mass 220 itself, for example with the aid of a pre-conveying pump.

As a result of the combination, shown in particular in FIGS. 1 and 2, of multiple valve-cylinder arrangements connected in parallel, piston rods 302, 305 of cylinders 301, 304 being connected to one another by means of piston rod yokes 307, a synchronization of the output of mass from both cylinders 301, 304 can be ensured. The predefined ratio of masses 220 to be outputted is ensured by the obligatory displacement of piston rods 302, 305 as a unit, because of piston rod yokes 307. As described above, switching rods 202, 205 of slider valves 201, 204 are preferably also connected by means of valve yokes 206, so that synchronous activation of cylinders 301, 304 can be ensured.

FIG. 5 shows the functional diagram of FIG. 4 with the valve-cylinder arrangement in a state different from the state shown in FIG. 4. First actuation space 221 of slider valve 201 has had pressure applied to it by means of pneumatic connector 213, so that switching rod 202 has been displaced in a second pressure action direction 224. In the instance shown, switching elements 203 enable communication between first valve inlet line 216 and first inlet line 311 of cylinder 301, and between first return line 312 of the cylinder and first valve return line 217. Communication between the other respective inlet lines resp. return lines 218, 219, 313, 314 is prevented by switching elements 203. The conveying pump can thus convey, into the other side of tubular chamber 309 as compared with the functional state of the valve-cylinder arrangement shown in FIG. 4, the mass 220 that is to be so outputted, so that piston 303 is displaced in the opposite direction in piston motion direction 315, and can in turn output mass 220 out of tubular chamber 309, by means of the opened return line 312, through slider valve 201 to valve return line 217 in product flow direction 316.

Valve inlet lines 216, 218 can open into one common feed opening that is connected to the single conveying pump for conveying, out of a reservoir, mass 220 that is to be outputted. Valve return lines 217, 219 can likewise be connected to one common return opening to which a mixer can be attached in order to allow the masses 220 to be outputted by means of cylinder 301, 304 to be mixed with one another and to be outputted in the mixed state through a delivery opening.

FIG. 6 is a sectioned side view of an alternative functional diagram of a valve-cylinder arrangement of the output system of FIG. 2. It depicts slide valve 201, which is connected to cylinder 301. Here as well, slide valve 201 comprises a switching rod 202 that protrudes at both ends out of valve housing 214. At the protruding ends, the switching rod is connected via a valve yoke (not shown) to switching rods of further slide valves (not depicted). In addition, a piston rod of a pneumatic cylinder (not shown) engages on the valve yoke, which rod enables a displacement of switching rod 202 of slide valve 201 as a unit together with the other switching rods of the further slide valves. It is thereby possible, as depicted for example in FIG. 3, to displace multiple switching rods 202, 205 of multiple slide valves 201, 204 synchronously by way of, preferably, a single pneumatic cylinder 700, and thus to activate slide valves 201, 204 synchronously.

Slide valve 201 shown in FIG. 6 comprises valve inlet lines resp. valve return lines 216, 217, 218, 219 that can be covered resp. uncovered by switching elements 203 arranged inside housing 214 displaceably by means of switching rod 202, in order to communicate with a combined first inlet line and return line 311, 312 and a second combined inlet line and return line 313, 314. The use of these combined inlet lines and return lines 311, 312, 313, 314 has the advantage that they can be used for product flow directions 316 from slide valve 201 toward cylinder 301 and in the opposite direction, depending on how switching elements 203 of slide valve 201 make available conveyance of mass 220, for example by means of the conveying pump, and an output capability of mass 220, for example to a mixer. The mode of operation of cylinder 301 itself corresponds to that of cylinder 301 in FIGS. 4 and 5. Piston 303 is displaced by mass 220 itself by means of, for example, a conveying pump (not depicted), so that mass 220 can be outputted. A separate drive system of cylinder 301 is preferably not provided. One or more further cylinders 304 are connected via their respective piston rods 305 to cylinder 301 that is shown, via a connecting means, for example via a piston rod yoke 307 already described, at the ends of piston rod 302 that protrude out of housing 308, as shown for example in FIGS. 2 and 3.

FIG. 7 the functional diagram of FIG. 6 with the valve-cylinder arrangement in a state different from the state shown in FIG. 6. Switching rod 202 of slide valve 201 is displaced, by means of the pneumatic cylinder (not shown), in such a way that switching elements 203 communication between first valve inlet line 216 and first inlet line 311 of cylinder 301, and between first return line 312 of the cylinder and first valve return line 217. Communication of the respective other inlet lines and return lines 218, 219 with cylinder 301, which might lead to a malfunction or to a blockage of mass 220 in the combined inlet lines and return lines 311, 312, 313, 314 of cylinder 301, is prevented by switching elements 203. Piston 303 is moved by means of mass 220 in piston motion direction 315, oppositely to the direction in the instance shown in FIG. 6, resulting in an output of mass 220 in product flow direction 316, by means of the opened return line 312, through slider valve 201 to valve return line 217.

LIST OF REFERENCE CHARACTERS

100 Output system
200 Control unit
201 First slider valve
202 Switching rod
203 Switching elements
204 Second slider valve
205 Switching rod
206 Valve yoke
207 First connector adapter
208 Feed opening
209 Return feed opening
210 Second connector adapter
211 Feed opening
212 Return feed opening
213 Pneumatic connectors
214 Valve housing
215 Valve orifice
216 First valve inlet line
217 First valve return line
218 Second valve inlet line
219 Second valve return line
220 Mass
221 First actuation space
222 Second actuation space
223 First pressure action direction
224 Second pressure action direction
300 Cylinder unit
301 First cylinder
302 Piston rod
303 Piston
304 Second cylinder
305 Piston rod
306 Mounting plate
307 Piston rod yoke
308 Cylinder housing
309 Tubular chamber
310 Distributing valve
311 First inlet line
312 First return line
313 Second inlet line
314 Second return line
315 Piston motion direction
316 Product flow direction
400 First reservoir
401 Second reservoir
500 First conveying pump
501 Second conveying pump
600 Mixing apparatus
601 Output opening
700 Pneumatic cylinder
701 Pneumatic connectors
702 Piston rod

What is claimed is:

1. An output system for the extraction and/or output of plural masses, comprising a cylinder unit made up of at least two double-acting cylinders each having a piston, displaceable by means of a piston rod, for extraction and/or output of one of the masses in each case, the piston rods being arranged parallel to one another and being connected to one another via at least one connecting element in such a way that the connected piston rods are displaceable as a unit; and a control unit made up of at least two slider valves for controlling the entry and return of the masses to the cylinders, wherein each slider valve comprises a displaceable switching element connected to a respective switching rod, the switching rods being arranged parallel to one another, both switching rods connected to one another via at least one connecting element in such a way that the connected switching rods are displaceable as a unit.

2. The output system according to claim 1, wherein synchronized-speed cylinders are used as double-acting cylinders; and the piston rods are connected to one another on both sides of the cylinders by means of the connecting elements.

3. The output system according to claim 1, wherein at least one conveying pump is provided in order to convey at least one mass; and at least one piston of a cylinder is displaceable by means of the mass.

4. The output system according to claim 1, wherein each switching element is linearly displaceable within the slider valve.

5. The output system according to claim 1, wherein the connected switching rods are linearly displaced in the same direction by the connecting element.

6. The output system according to claim 1, wherein the connected piston rods are linearly displaced in the same direction by the connecting element.

7. The output system according to claim 1, wherein the switching element is linearly displaceable within the slider valve to selectively control flow of masses through the slider valve.

8. The output system according to claim 1, wherein the piston rods and switching rods are parallel to each other.

9. The output system according to claim 1, wherein the piston rods are longitudinally spaced from each other, each piston rod defining a free end and the connecting element is connected to each piston rod adjacent that piston rod free end.

10. The output system according to claim 1, wherein the switching rods are longitudinally spaced from each other, each switching rod defining a free end and the connecting element is connected to each switching rod adjacent that switching rod free end.

* * * * *